US005453173A

United States Patent [19]

Oyama

[11] Patent Number: 5,453,173

[45] Date of Patent: Sep. 26, 1995

[54] PROCESS FOR MANUFACTURING A THREE-DIMENSIONAL ELECTROFORMED MOLD SHELL

[75] Inventor: Kanji Oyama, Konan, Japan

[73] Assignee: KTX Co., Ltd., Konan, Japan

[21] Appl. No.: 179,354

[22] Filed: Jan. 10, 1994

[30] Foreign Application Priority Data

Jan. 28, 1993 [JP] Japan ..... 5-034923

[51] Int. Cl.[6] ..... C25D 1/10; B29C 33/38

[52] U.S. Cl. ..... 205/70; 205/75; 205/150; 205/161; 264/225; 264/226; 249/114.1; 249/116; 425/84

[58] Field of Search ..... 205/70, 75, 150, 205/161; 264/225, 226; 249/114.1, 116, 141; 425/84, 85

[56] References Cited

U.S. PATENT DOCUMENTS

| | | | |
|---|---|---|---|
| 1,323,167 | 11/1919 | Denny | 205/150 |
| 2,870,068 | 1/1959 | Schaer | 205/75 |
| 3,192,136 | 6/1965 | Reid | 205/70 |
| 3,346,465 | 10/1967 | Franck | 205/150 |
| 3,622,284 | 11/1971 | Bart | 205/75 |
| 3,699,028 | 10/1972 | Torley et al. | 205/75 |
| 4,063,705 | 12/1977 | Vodia | 425/388 |
| 4,435,252 | 3/1984 | Kadija | 205/75 |
| 4,781,569 | 11/1988 | Kinugasa et al. | 425/388 |
| 4,846,938 | 7/1989 | Tazaki et al. | 205/75 |
| 5,013,409 | 5/1991 | Czor | 205/67 |

FOREIGN PATENT DOCUMENTS

| | | | |
|---|---|---|---|
| 2046946 | 4/1971 | Germany | 205/75 |
| 2829529 | 1/1980 | Germany . | |
| 3142747 | 5/1983 | Germany . | |
| 47-12008 | 5/1972 | Japan . | |
| 60-152692 | 8/1985 | Japan | 205/70 |
| 61-48297 | 3/1986 | Japan . | |
| 2026034 | 7/1978 | United Kingdom . | |
| 2108154 | 10/1981 | United Kingdom . | |

OTHER PUBLICATIONS

Die Zuckerherstellung, VEB Fachbuchverlag Leipzig 1965 pp. 252–257.

*Primary Examiner*—Jay H. Woo
*Assistant Examiner*—Robert B. Davis
*Attorney, Agent, or Firm*—Cushman, Darby & Cushman

[57] ABSTRACT

A three-dimensional electroformed shell for a mold consists of a three-dimensional thin-walled body, and an electroformed coating deposited on it. The coating may, or may not close the base holes of the thin-walled body completely. If it does not close the base holes completely, the shell has a multiplicity of apertures. A process for manufacturing the shell is also disclosed.

12 Claims, 8 Drawing Sheets

PROCESS FOR MANUFACTURING A THREE-DIMENSIONAL ELECTROFORMED MOLD SHELL

BACKGROUND OF THE INVENTION

1. Field of the Invention

This invention relates to a three-dimensional electroformed shell for a mold and a process for manufacturing the same. The shell can be used for a variety of kinds of molds including a mold for making paper from pulp fiber, a mold for blowing a fibrous or granular material, a mold for foaming beads of polystyrene, polypropylene, or modified polyphenylene ether, a screen mold for preforming glass fiber, and a mold for making a molded resin product by vacuum, blow, stamping, injection, RIM urethane, or compression molding.

2. Description of Related Art

A three-dimensional electroformed shell having a multiplicity of apertures is used for a mold for making paper from pulp fiber. The apertures usually occupy about 1 to 50% by area of the surface of the shell. A number of methods have hitherto been employed for manufacturing such a shell, as summarized below.

(1) A punched metal plate having a multiplicity of apertures is pressed into a three-dimensional shape. It has, however, been impossible to form a punched metal plate into a complicated three-dimensional shape because of its poor press formability. Moreover, the use of an expensive press tool has resulted in an expensive product.

(2) A punched metal plate is bent, cut and welded into a three-dimensional shape. This method has, however, been able to make only a product of low dimensional accuracy. Moreover, the necessity of a great deal of time and labor has resulted in an expensive product.

(3) A three-dimensional shell having a small wall thickness is cast from e.g. an aluminum alloy, and apertures are drilled in the shell. The shell has however, been low in dimensional accuracy because of e.g. the warpage of its wall having a small thickness. Moreover, the necessity of a great deal of time and labor for drilling a multiplicity of apertures has resulted in an expensive product. It has even been difficult to drill the apertures in some portion or portions of the shell if it has a complicated shape.

SUMMARY OF THE INVENTION

Under these circumstances, it is an object of this invention to provide a novel three-dimensional electroformed shell for a mold which is easy to manufacture at a low cost and has a high dimensional accuracy, even if it may have a complicated shape.

This object is attained by a shell which comprises a three-dimensional thin-walled body having a multiplicity of base holes, and an electroformed coating deposited on the body. The shell is so simple in construction that its manufacture calls for only a small amount of time and labor. The electroformed coating may be so formed as to diminish the base holes of the thin-walled body in size to form a multiplicity of apertures in the shell. In this case, the shell can be used for the molds from which air, gas or water must be removed through the apertures, such as a mold for making paper, a blowing mold, a mold for foaming beads, a screen mold, a mold for vacuum molding, and a mold for RIM urethane molding. The shell can be also used for such a mold as to make a product by blow, stamping, injection, or compression molding, so that the apertures provide vent holes for removing gas from the mold. The coating may alternatively be so formed as to close the base holes of the thin-walled body completely. In this case, the shell can be used for such a mold to make a product by blow, stamping, injection, or compression molding.

It is another object of this invention to provide a process which can manufacture a three-dimensional electroformed shell for a mold easily at a low cost and with a high dimensional accuracy.

This object is attained by a process which comprises the steps of deforming a thin-walled body having a multiplicity of base holes into a three-dimensional shape on and along the surface of a three-dimensional model, and forming an electroformed coating on the deformed thin-walled body. This process facilitates the manufacture of a three-dimensional shell having a high dimensional accuracy, while enabling a reduction in time and labor, even if it may have a complicated shape. The electroforming conditions are appropriately selected to form apertures in the shell, or not to form any aperture, or to vary the percentage by area which the apertures may occupy in the surface of the shell.

The step of deforming a thin-walled body may be carried out while bonding it to the surface of the model. This is the easiest way to carry out the step.

The step of forming an electroformed coating may include forming a preliminary thin electroformed coating on the deformed thin-walled body to prepare an intermediate shell product, removing at least the major part of the model from the intermediate product, and forming a final electroformed coating on the intermediate product. In this case, the preliminary electroformed coating fixes the thin-walled body, so that the removal of at least the major part of the model from the intermediate product does not bring about any deformation of the latter. The final electroformed coating can be formed uniformly on both sides of the intermediate product from which at least the major part of the model has been removed, and hold it against warpage.

The step of deforming a thin-walled body may include fixing the deformed thin-walled body with a resin, removing at least the major part of the model from the thin-walled body, and imparting electric conductivity to the surface of the thin-walled body. In this case, the resin fixes the thin-walled body, so that the removal of at least the major part of the model from the thin-walled body does not bring about any deformation of the latter. An electroformed coating can be formed uniformly on both sides of the thin-walled body from which at least the major part of the model has been removed, and hold it against warpage.

The step of deforming a thin-walled body may alternatively include placing a layer of granular material in the base holes of the deformed thin-walled body, fixing the thin-walled body and the granular material with a resin, removing at least the major part of the model from the thin-walled body, and imparting electric conductivity to the surfaces of the thin-walled body and the granular material. In this case, as the base holes of the thin-walled body are closed by the granular material, no prolonged electroforming operation is required for making a shell having no aperture.

The step of forming an electroformed coating may include forming a preliminary thin electroformed coating on the deformed thin-walled body to prepare an intermediate shell product, removing the thin-walled body from the intermediate product, and forming a final electroformed coating on the intermediate product.

The thin-walled body may be a network body, and the base holes may be the openings of the network body. The network body may be of an electrically conductive or non-conductive material, of which examples are shown below. If it is of a non-conductive material, electric conductivity is imparted to its surface prior to electroforming.

(a) Conductive material:

(1) Stainless steel, galvanized iron, brass, copper, aluminum, or other metal (or alloy) wire;

(2) Yarn formed by holding carbon fibers together;

(3) Yarn formed by holding together monofilaments of an electrically conductive resin, or electrically conductive fibers;

(b) Non-conductive material:

(1) Yarn formed by holding together inorganic fibers, such as glass, ceramic, or quartz fibers;

(2) Yarn formed by holding together chemical fibers, such as nylon, polyester, or polypropylene fibers, or monofilaments of a resin;

(3) Yarn formed by holding together natural fibers, such as hemp or cotton fibers.

Although it is usual to prepare the network body by knitting wires, yarns or monofilaments together as the intersecting elements, it is also possible to prepare it by welding the intersecting elements together, or sticking them together with an adhesive.

If the network body is of a non-conductive material, electric conductivity is imparted to its surface by e.g. applying a conductive paint (a paste of a conductive powder, such as a silver, copper or aluminum powder), a silver mirror reaction, electroless plating, vacuum evaporation, or sputtering.

The thin-walled body may alternatively be of metallic foil, and the base holes may be formed in the metallic foil. The metallic foil may be of e.g. aluminum, copper or stainless steel.

A conductive network body can be bonded to the surface of a three-dimensional model by, for example, employing a double-sided pressure-sensitive adhesive tape, a pressure-sensitive adhesive, or another type of adhesive therebetween.

The model may be of a material such as a resin, solid wax, plaster, wood, ceramics, metal, or carbon, and may be prepared by a method which depends on the material selected. The electroformed coating can be formed from e.g. nickel, a nickel-cobalt alloy, copper, or a copper-cobalt alloy.

Other and further objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE PREFERRED EMBODIMENTS

Reference is first made to FIGS. 1 to 9 for the description of the first embodiment of this invention directed to an electroformed shell having a complicated three-dimensional shape and adapted for use with a mold for blowing a fibrous or granular material, and a process for manufacturing the same.

Figure 1:
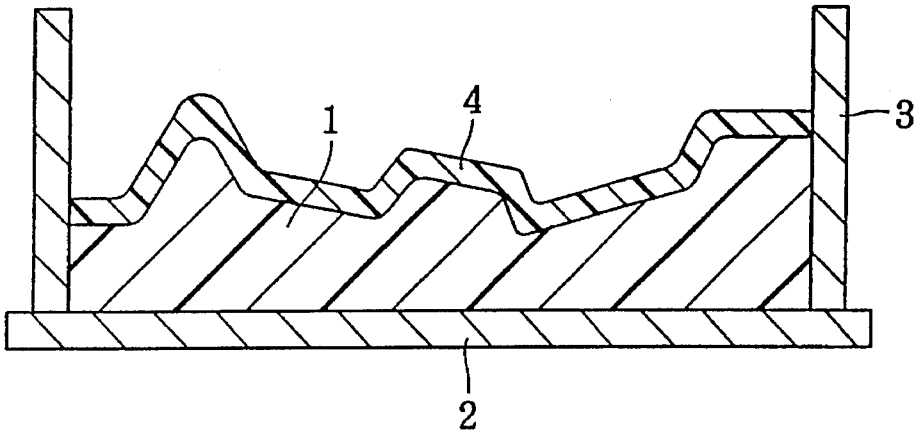
FIG. 1 is a sectional view of a model and an inverted model as prepared in accordance with a first embodiment of this invention.

A model 1 having a complicated three-dimensional shape was formed from an epoxy resin, and secured on a table 2, as shown in FIG. 1. The model 1 was surrounded by a frame 3, and a molten epoxy resin was poured onto the surface of the model 1 to form an inverted model 4 shaped like a shell.

Figure 2:
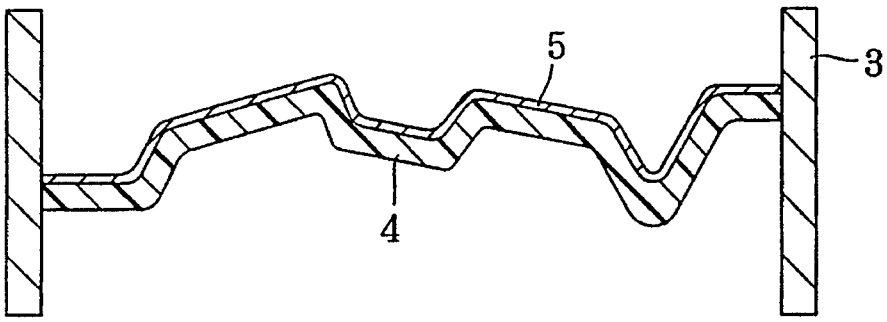
FIG. 2 is a sectional view of the inverted model shown in FIG. 1 and a double-sided pressure-sensitive adhesive tape applied to it.

Then, the frame 3 and the inverted model 4 were turned upside down, and a double-sided pressure-sensitive adhesive tape 5 was applied to the upper surface of the inverted model 4 (its surface which was complementary to the surface of the model 1), as shown in FIG. 2.

Figure 3:
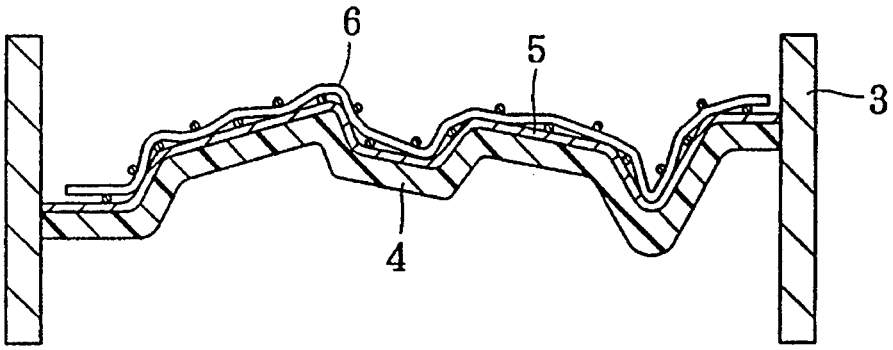
FIG. 3 is a sectional view further including a network body stuck to the adhesive tape.
Figure 4A:
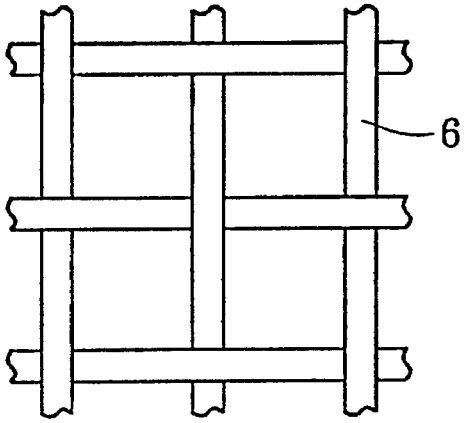
FIG. 4(*a*) is an enlarged top plan view of the network body shown in FIG. 3, and FIG. 4(*b*) is an enlarged sectional view thereof.
Figure 4B:
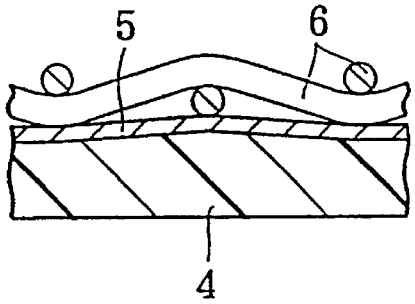

Then, a network body 6 was placed on the adhesive tape 5, and deformed into a three-dimensional shape so as to adapt itself to the three-dimensional upper surface of the inverted model 4, while it was bonded to the inverted model 4 by the adhesive tape 5, as shown in FIG. 3. Although the whole network body 6 could easily be deformed along the inverted model 4, it is sometimes possible that the three-dimensional surface may have so complicated a shape that a network body has a portion or portions failing to be properly deformed. In such a case, it is effective to, for example, cut any such portion and weld it by using a small spot welding machine. This method hardly brings about any reduction in dimensional accuracy. The network body 6 was of the construction as shown in FIGS. 4(*a*) and 4(*b*), and was a grid formed by knitting stainless steel wires having a diameter of 0.4 mm, and had an opening size of 10 mesh.

Figure 5:
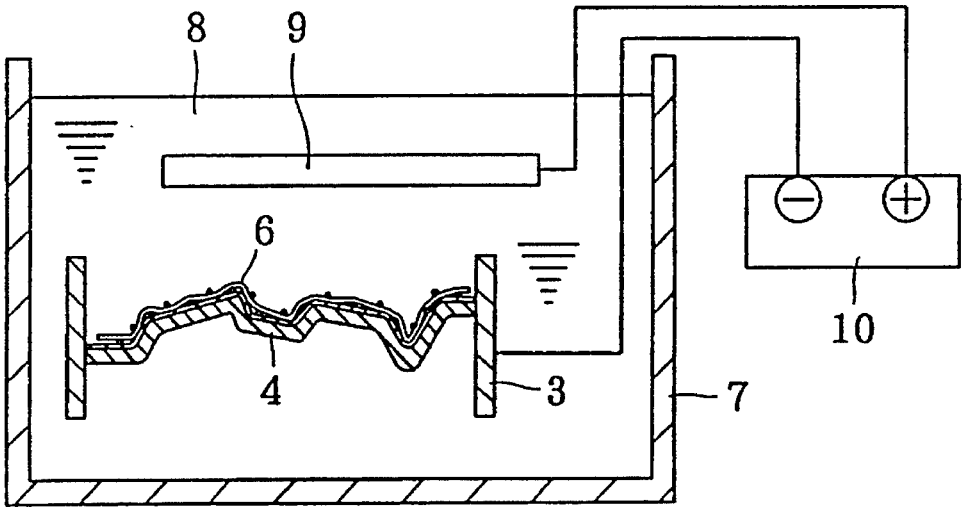
FIG. 5 is a diagram illustrating an electroforming operation for the network body.

The network body 6 bonded to the inverted model 4 was immersed as a cathode in an electroforming solution 8 held in a vessel 7, in which a nickel electrode 9 employed as a source of supply of the metal to be deposited was also immersed as an anode, as shown in FIG. 5. A DC voltage was applied between the two electrodes from a DC power source 10 to carry out an electroforming operation. The electroforming solution 8 contained 300 to 450 g of nickel sulfamate, 0 to 10 g of nickel chloride and 30 to 45 g of boric acid, per liter. The solution 8 had a pH of 2.5 to 4.2, and a temperature of 30° to 50° C.

Figure 6:
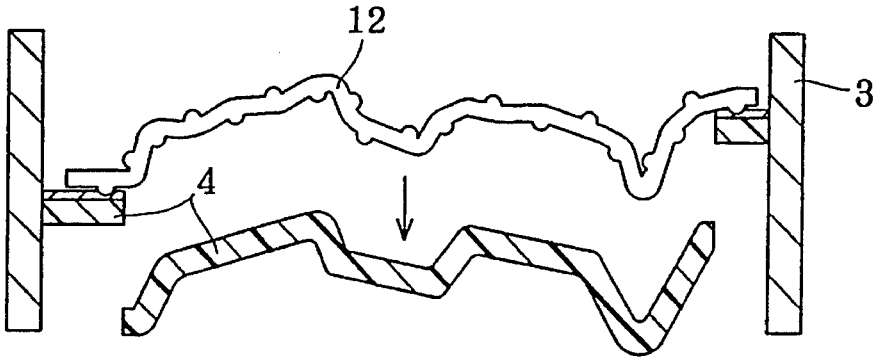
FIG. 6 is a sectional view of an intermediate shell product as prepared by the electroforming operation and the inverted model having its major part removed from the intermediate product.
Figure 7A:
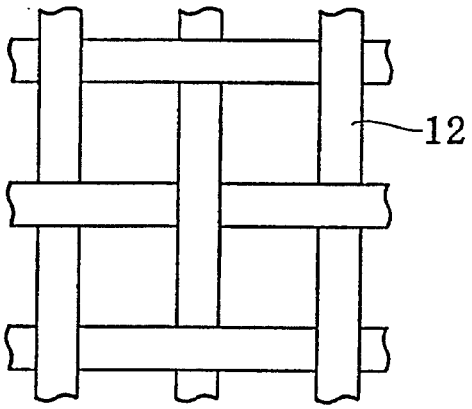
FIG. 7(*a*) is an enlarged top plan view of the intermediate product shown in FIG. 6, and FIG. 7(*b*) is an enlarged sectional view thereof.
Figure 7B:
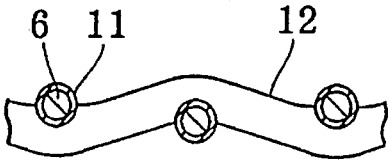

The electroforming operation was continued for two days at a cathode current density of 1 to 3 A/dm$^2$, whereby the network body 6 was covered with a thin electroformed coating 11 to yield an intermediate shell product 12, as shown in FIGS. 6, 7(*a*) and 7(*b*). The electroformed coating 11 surrounding the intersecting elements of the network body 6 had a thickness of 0.05 to 0.2 mm, and the intersecting elements of the intermediate product 12 had an outside diameter of 0.4 to 0.8 mm. The electroformed coating 11 fixed the intersecting elements of the network body 6 and their intersections, and thereby made the intermediate product 12 strong enough to resist deformation without the aid of the inverted model 4.

The electroforming operation was interrupted, and the frame 3, the inverted model 4 and the intermediate product 12 were removed from the electroforming solution 8. They were heated, whereby the adhesive tape 5 was softened, and the intermediate product 12 was separated from the inverted model 4 and the adhesive tape 5. The major parts of the inverted model 4 and the adhesive tape 5 were cut off their edge portions, and the intermediate product 12 was attached again to their edge portions, as shown in FIG. 6.

Figure 8:
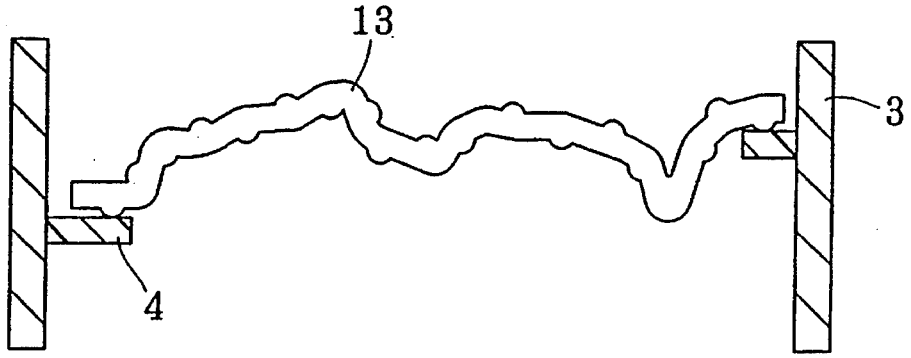
FIG. 8 is a sectional view of an electroformed shell as manufactured by another electroforming operation for the intermediate product.
Figure 9A:
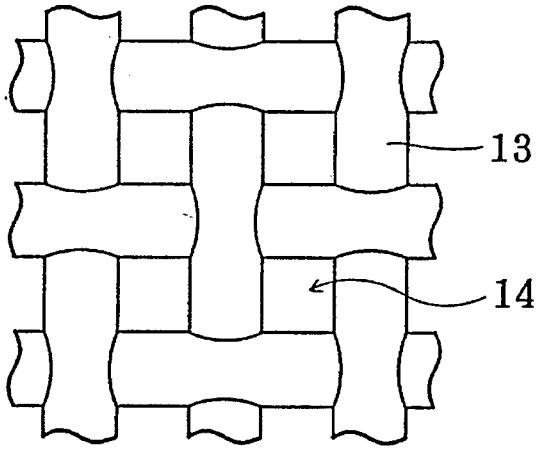
FIG. 9(*a*) is an enlarged top plan view of the shell shown in FIG. 8, and FIG. 9(*b*) is an enlarged sectional view thereof.
Figure 9B:
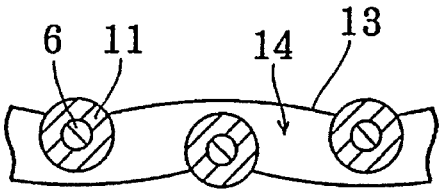

The frame 3, the edge portion of the inverted model 4 and the intermediate product 12 were immersed again in the electroforming solution 8, and the electroforming operation was resumed on both sides of the intermediate product 12. The operation was continued for four days at a cathode current density of 1 to 3 A/dm$^2$, whereby the network body 6 was covered with a thicker electroformed coating 11 to yield an electroformed shell 13, as shown in FIGS. 8, 9(*a*) and 9(*b*). The electroformed coating 11 surrounding the intersecting elements of the network body 6 had a total thickness of 0.35 to 0.5 mm, and the intersecting elements of the electroformed shell 13 had an outside diameter of 1.1 to 1.4 mm. The openings of the network body 6 were diminished in size by the electroformed coating 11 to form a multiplicity of apertures 14 in the shell 13. The apertures 14 occupied about 25% by area of the shell 13.

The shell 13 was separated from the remaining edge portion of the inverted model 4. There was no warpage of the shell 13. This was apparently due to the absence of any internal stress as a result of uniform electroforming on both sides of the intermediate product 12.

Description will now be made of the second embodiment of this invention. After the process as hereinabove described with reference to FIGS. 1 to 4 had been repeated, an electroforming operation was continued for 10 days at a cathode current density of 1 to 3 A/dm$^2$ on a network body 6 bonded to an inverted model 4 as shown in FIG. 5 to make an electroformed shell 13 as shown in FIGS. 8 and 9. The apertures 14 occupied about 20% by area of the shell 13.

The shell 13 was substantially comparable to the product according to the first embodiment. The second embodiment, however, called for a longer electroforming time than the first embodiment, since the coating was formed mainly on one side of the network body 6 bonded to the inverted model 4.

Figure 10:
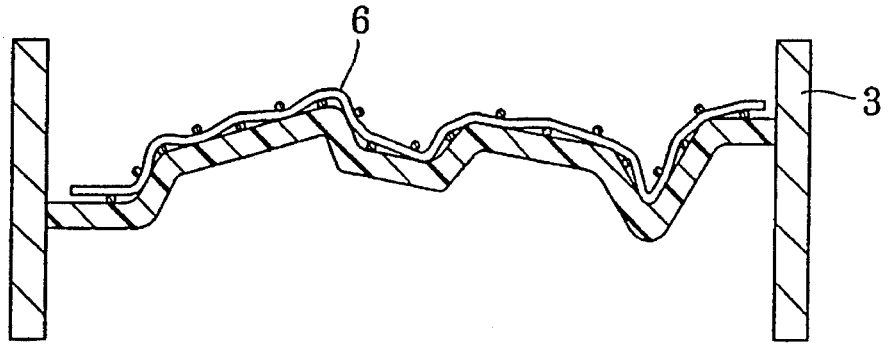
FIG. 10 is a sectional view of an inverted model and a network body as deformed thereon and fixed with a resin in accordance with a third embodiment of this invention.
Figure 11A:
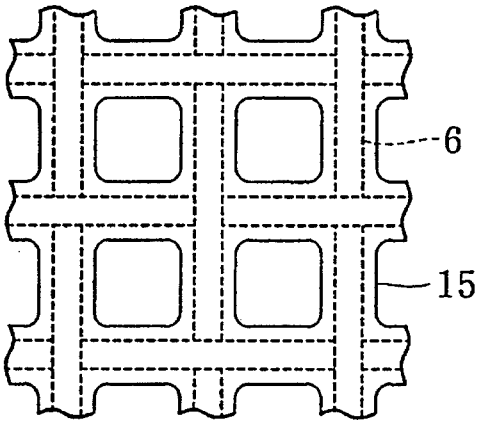
FIG. 11(*a*) is an enlarged top plan view of the network body shown in FIG. 10, and FIG. 11(*b*) is an enlarged sectional view thereof.
Figure 11B:
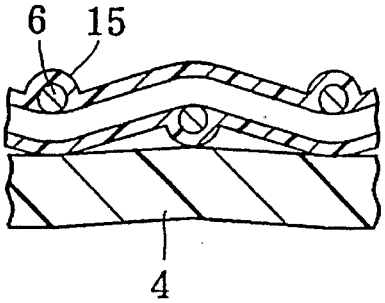
Figure 12:
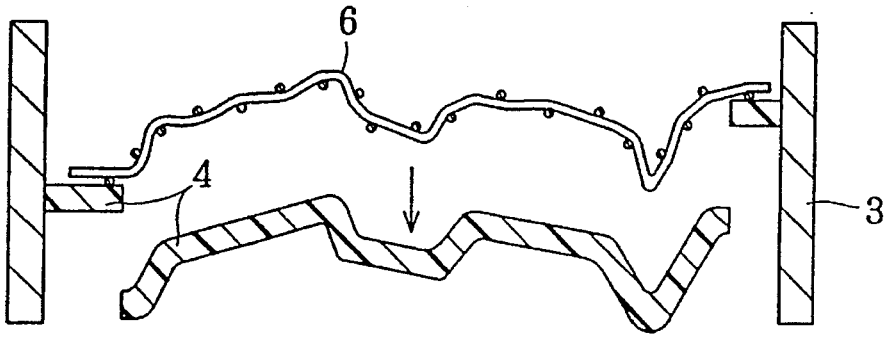
FIG. 12 is a sectional view of the network body shown in FIG. 10 and the inverted model having its major part removed from the network body.

Reference is now made to FIGS. 10 to 12, as well as the figures which have already been referred to, for the description of the third embodiment of this invention. After the step as described with reference to FIG. 1 had been repeated, a network body 6 was applied directly without the aid of any adhesive tape onto the upper surface of an inverted model 4 turned upside down, and was fixed with an epoxy resin 15, as shown in FIGS. 10, 11(*a*), and 11(*b*). The network body 6 was a grid formed by knitting together yarns of glass fibers having a cross-sectional size of 1×1.2 mm, and had an opening size of 8 mesh. The hardening of the epoxy resin 15 adhering to the yarns and their intersections, and penetrating the glass fibers made the network body 6 strong enough to resist deformation without the aid of the inverted model 4.

The network body 6 was separated from the inverted model 4, and after the major part of the inverted model 4 had been cut off its edge portion, the network body 6 was attached again to the remaining edge portion of the inverted model 4, as shown in FIG. 12. Electric conductivity was imparted to the surface of the network body 6 by a silver mirror reaction (not shown). An electroforming operation was continued for eight days at a cathode current density of 1 to 3 A/dm$^2$ on both sides of the network body 6 to yield an electroformed shell 13 which was similar to that shown in FIGS. 8 and 9. The apertures 14 occupied about 30% by area of the shell 13.

Figure 13A:
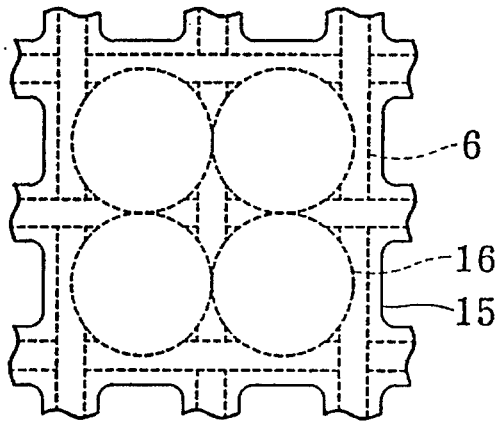
FIG. 13(*a*) is an enlarged top plan view of a network body and a granular material placed on it in accordance with a fourth embodiment of this invention, and FIG. 13(*b*) is an enlarged sectional view thereof.
Figure 13B:
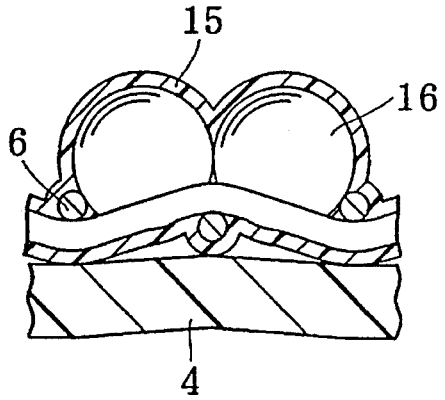

Attention is now directed to FIGS. 13(*a*) and 13(*b*) showing the fourth embodiment of this invention. This embodiment is characterized by placing a layer of granular material 16 in the openings of a network body 6 deformed on an inverted model 4, and fixing the network body 6 and the granular material 16 with an epoxy resin 15. It is otherwise equal to the third embodiment. An electroforming operation was continued for five days at a cathode current density of 1 to 3 A/dm$^2$ on both sides of the network body 6 and the granular material 16 to which electric conductivity had been imparted, whereby an electroformed shell having no aperture was obtained.

Figure 14A:
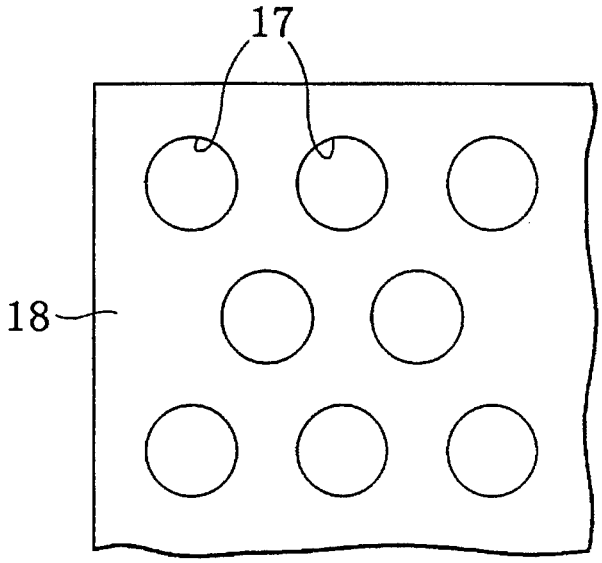
FIG. 14(*a*) is an enlarged top plan view of metallic foil employed in a fifth embodiment of this invention, and FIG. 14(*b*) is an enlarged sectional view thereof.
Figure 14B:
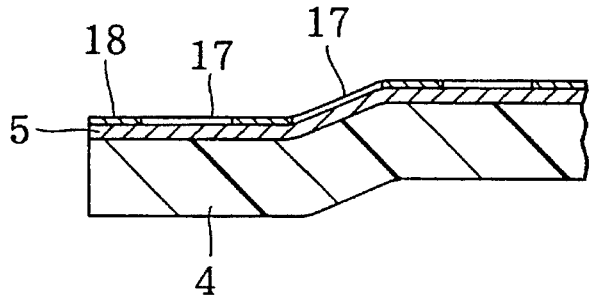

Reference is now made to FIGS. 14(*a*) to 17(*a*) for the description of the fifth embodiment of this invention. In this embodiment, aluminum foil 18 in which a multiplicity of base holes 17 were punched (as shown in FIG. 14(*a*)) was used in place of the network body. The aluminum foil 18 had a thickness of 50 μm, and each of the base holes 17, which were formed so as to have a distance of 5 mm between the centers of the adjacent holes 17, had a diameter of 3 mm.

Figure 15:
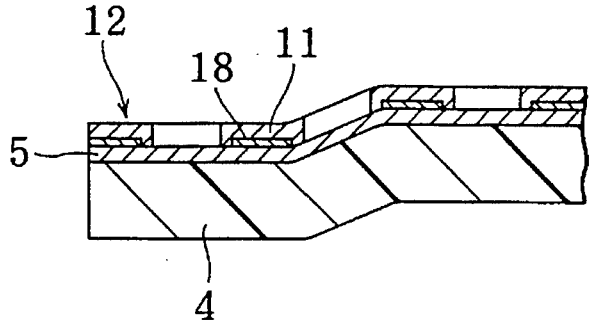
FIG. 15 is an enlarged sectional view of an intermediate shell product as prepared by an electroforming operation for the metallic foil.

The aluminum foil 18 was bonded to an inverted model 4 by a double-sided pressure-sensitive adhesive tape 5, as shown in FIG. 14(*b*). An electroforming operation was carried out for the aluminum foil 18 bonded to the inverted model 4 to yield an intermediate shell product 12, as shown in FIG. 15. An electroformed coating 11 formed on one side (where the inverted model 4 was not bonded) of the aluminum foil 18 had a thickness of about 0.05 mm, and thereby made the intermediate product 12 strong enough to resist deformation without the aid of the inverted model 4. The other side of the aluminum foil 18 had no electroformed coating.

Figure 16:
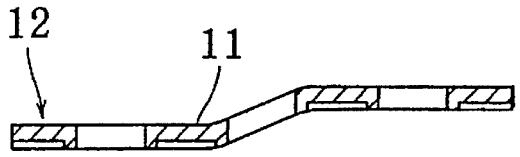
FIG. 16 is an enlarged sectional view of the intermediate shell product as removed from the metallic foil.
Figure 17A:
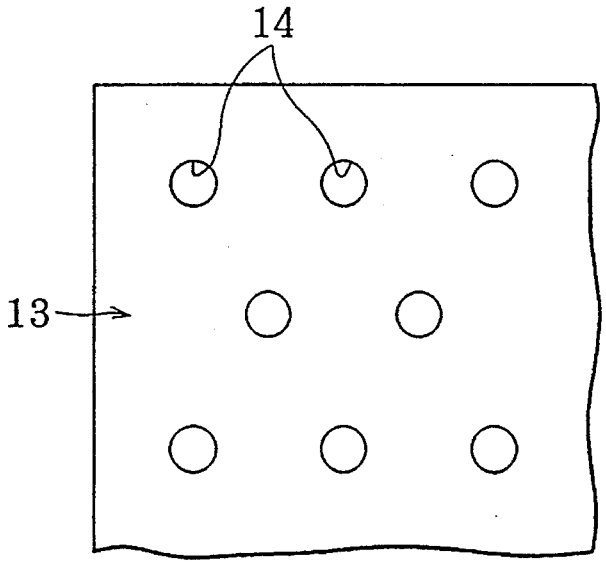
FIG. 17(*a*) is an enlarged top plan view of an electroformed shell as manufactured by another electroforming operation for the intermediate product shown in FIG. 16, and FIG. 17(*b*) is an enlarged sectional view thereof.
Figure 17B:
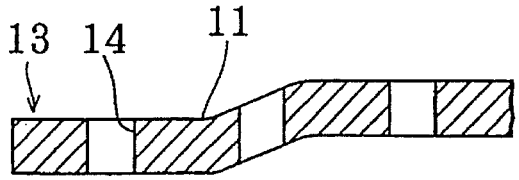

The electroforming operation was interrupted, and the intermediate product 12 was separated from the inverted model 4, the adhesive tape 5 and the aluminum foil 18, as shown in FIG. 16. The electroforming operation was resumed on both sides of the intermediate product 12, whereby an electroformed coating 11 with another thickness of about 0.5 mm was formed on each side of the intermediate product 12. This resulted in yielding an electroformed shell 13 having a thickness of about 1.5 mm, as shown in FIG. 17. The base holes 17 were diminished in size by the electroformed coating 11 to form a multiplicity of apertures 14 in the shell 13. Each of the apertures 14 had a diameter of about 1.5 mm.

As many apparently widely different embodiments of this invention may be made without departing from the spirit and scope thereof, it is to be understood that the invention is not limited to the specific embodiments thereof except as defined in the appended claims.

What is claimed is:

1. A process for manufacturing a three-dimensional electroformed shell for a mold which comprises the steps of:

deforming a thin-walled body having a multiplicity of base holes into a three-dimensional shape along a surface of a rigid three-dimensional model; and forming an electroformed coating on said deformed body.

2. A process for manufacturing an electroformed shell as set forth in claim 1, wherein the step of forming includes coating said electroformed body so that said base holes of said thin-walled body are decreased in size to form a multiplicity of apertures.

3. A process for manufacturing an electroformed shell as set forth in claim 1, wherein the step of forming includes coating said thin-walled body so as to close the base holes thereof.

4. A process as set forth in claim 1, wherein said deforming step is carried out while bonding said body to the surface of said model.

5. A process for manufacturing a three-dimensional electroformed shell for a mold which comprises the steps of:

deforming a thin-walled body having a multiplicity of base holes into a three-dimensional shape along a surface of a three-dimensional model; and forming an electroformed coating on said deformed body;

wherein said forming step comprises:

forming a thin electroformed coating on said deformed body to prepare an intermediate shell product;

removing at least a part of said model from said intermediate product; and forming a final electroformed coating on said intermediate product.

6. A process for manufacturing a three-dimensional electroformed shell for a mold which comprises the steps of:

deforming a thin-walled body having a multiplicity of base holes into a three-dimensional shape along a surface of a three-dimensional model; and forming an electroformed coating on said deformed body;

wherein said deforming step further includes:

fixing said deformed body with a resin;

removing at least a major part of said model from said body; and imparting electric conductivity to the surface of said body.

7. A process for manufacturing a three-dimensional electroformed shell for a mold which comprises the steps of:

deforming a thin-walled body having a multiplicity of base holes into a three-dimensional shape along a surface of a three-dimensional model; and forming an electroformed coating on said deformed body;

wherein said deforming step further includes:

placing a layer of granular material in the base holes of said deformed body;

fixing said body and said granular material with a resin;

removing at least a major part of said model from said body; and imparting electric conductivity to the surfaces of said body and said granular material.

8. A process for manufacturing a three-dimensional electroformed shell for a mold which comprises the steps of:

deforming a thin-walled body having a multiplicity of base holes into a three-dimensional shape along a surface of a three-dimensional model; and forming an electroformed coating on said deformed body;

wherein said forming step comprises:

forming a thin electroformed coating on said deformed body to prepare an intermediate shell product;

removing said deformed body from said intermediate product; and forming a final electroformed coating on said intermediate product.

9. A process for manufacturing an electroformed shell as set forth in claim 1, wherein said deforming step includes deforming a network body, having openings corresponding to said base holes.

10. A process for manufacturing an electroformed shell as set forth in claim 1, wherein said deforming step includes deforming a metallic foil, in which said base holes are formed.

11. A process as set forth in claim 1, wherein said thin-walled body is a network body, the openings of which are said base holes.

12. A process for manufacturing a three-dimensional electroformed shell for a mold which comprises the steps of:

deforming a thin-walled body having a multiplicity of base holes into a three-dimensional shape along a surface of a three-dimensional model; and forming an electroformed coating on said deformed body;

wherein the step of deforming includes deforming a metallic foil, in which said base holes are formed.

* * * * *